US005364730A

United States Patent [19]

Kojima et al.

[11] Patent Number: 5,364,730

[45] Date of Patent: Nov. 15, 1994

[54] TONER FOR DEVELOPING ELECTROSTATIC IMAGES AND METHOD FOR MANUFACTURING THEREOF

[75] Inventors: Haruji Kojima; Tsugio Abe; Toru Shoji; Meizo Shirose, all of Hachioji, Japan

[73] Assignee: Konica Corporation, Japan

[21] Appl. No.: 219,877

[22] Filed: Mar. 30, 1994

Related U.S. Application Data

[63] Continuation of Ser. No. 871,931, Apr. 21, 1992, abandoned.

[30] Foreign Application Priority Data

Apr. 25, 1991 [JP] Japan ..... 3-121808

[51] Int. Cl.[5] ..... G03G 5/00

[52] U.S. Cl. ..... 430/137; 430/111

[58] Field of Search ..... 430/137, 111

[56] References Cited

U.S. PATENT DOCUMENTS 4,996,126 2/1991 Anno et al. ..... 430/106.6
5,178,460 1/1993 Kanda et al. ..... 366/303
5,215,854 6/1993 Yamazaki et al. ..... 430/137

*Primary Examiner*—Morton Foelak
*Assistant Examiner*—Richard L. Jones
*Attorney, Agent, or Firm*—Jordan B. Bierman

[57] ABSTRACT

A toner preparation process is disclosed. The process comprises a step of stirring the premixed colored resin particles and inorganic fine particles in the presence of mixing medium having a substantially spherical shape in the container, and a step of collecting toner particles comprised of the colored resin and inorganic particles thereon having a predetermined size by classifying at the stirring step.

A continuous method for manufacturing a toner for an electrostatic imaging is provided. The resulting toner is low in electricity consumption, free from limitation on processing volume, and the method is capable of improving productivity and reducing manufacturing cost.

13 Claims, 3 Drawing Sheets

TONER FOR DEVELOPING ELECTROSTATIC IMAGES AND METHOD FOR MANUFACTURING THEREOF

This application is a continuation of application Ser. No. 07/871931, filed Apr. 21, 1992, now abandoned.

BACKGROUND OF THE INVENTION

The present invention relates to an electrostatic image developing toner used in electrophotography, electrostatic recording and electrostatic printing, and to a method for manufacturing thereof.

With the view of improving the flowability and stabilizing the electrification property of an electrostatic image developing toner used, for example, in electrophotography, inorganic fine particles such as silica fine particles are added in colored resin particles in the toner.

There has so far been known a technique to incorporate inorganic particles into colored resin particles by use of a fixed-container type batch mixer having high-speed stirring blades, such as Henschel mixer.

Such a mixer, however, has disadvantages that the peripheral speed is greatly different from the central portion near the rotation axis to the tips of the stirring blades, and that no stirring blades are present near the rotation axis, thereby the stirring force and dispersing force vary locally. As a result, inorganic particles are liable to be ununiformly dispersed on the surface of colored resin particles, lowering the flowability and electrification stability of a toner.

In order to solve such problems, there is proposed a sort of electro-magnetic hybrid technique, which comprises the steps of feeding colored resin particles and inorganic fine particles to a mixing zone holding working pieces (mixing medium) composed of rods of ferromagnetic material, and applying a shifting magnetic field to this mixing zone from the outside to have the working pieces begin random movement by means of the electromagnetic force due to the interaction with this shifting magnetic field. (Japanese Pat. O.P.I. Pub No. 291670/1987)

SUMMARY OF THE INVENTION

One object of the present invention is to provide, in a simple procedure, an electrostatic image developing toner and a method for manufacturing thereof, which is capable of giving a uniform dispersion of inorganic fine particles on the surface of colored resin particles.

It is a further object of the present invention to provide a continuous method for manufacturing an electrostatic image developing toner containing colored resin particles and inorganic fine particles, which is low in electricity consumption, free from limitation on processing volume, and capable of improving productivity and reducing manufacturing cost.

The electrostatic image developing toner of the invention is prepared by mixing colored resin particles and inorganic fine particles in the presence of a mixing medium comprised of substantially spherical particles.

In the invention, the volume average particle diameter of the above mixing medium is preferably 0.1 to 10 mm, especially 0.5 to 5.0 mm. The specific gravity of the mixing medium is preferably 2.0 to 4.0.

In the invention which uses a mixing medium comprised of substantially spherical particles, the movement of the mixing medium is much smoother as compared with use of a rod-type mixing medium, and the filling rate of the mixing medium in a mixing container can be made much higher because of its substantially spherical shape of the constituent particles. Accordingly, these mixing medium particles can contact with colored resin particles or inorganic fine particles at a higher probability, and thereby a microscopically uniform mixing is achieved in a short time.

Because of the substantially spherical shape of the mixing medium particles, the compressive action, frictional action and shearing action of the mixing medium exerted on colored resin particles or inorganic fine particles vary little with positions at which a mixing medium particle contacts with them, as compared with the case of using a rod-type mixing medium; therefore, colored resin particles or inorganic fine particles are given uniform actions by the mixing medium, and thereby a microscopically uniform mixing is readily achieved.

Moreover, the intensity of mixing can be adjusted with a broad degree of freedom by selecting a suitable mixing medium, because the mixing medium particles contact with colored resin particles or inorganic fine particles at a high probability as mentioned above. As a result, a soft and microscopically uniform mixing can be made without causing much damage to colored resin particles.

DETAILED DISCLOSURE OF THE INVENTION

Figure 1:
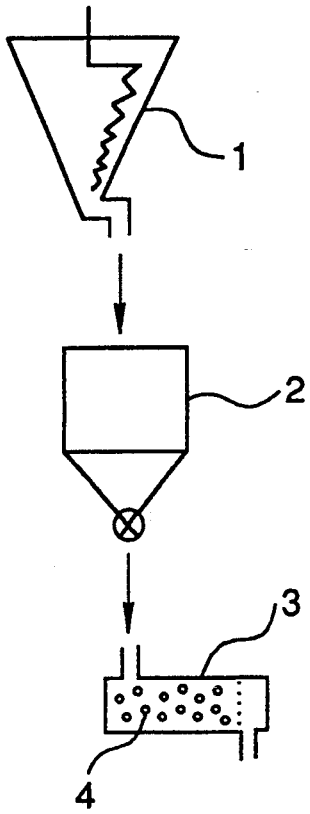
FIG. 1 is an explanation drawing to show, in sequence of processes, one example of the manufacturing method of the invention.

In the invention, the wording "the mixing medium comprised of substantially spherical particles" means that the mixing medium is comprised of spherical or elliptic particles close to spheres. To be concrete, the average ratio of the minor axis a of the mixing medium particles to the major axis b thereof a/b is preferably 0.8 to 1.0, especially 0.9 to 1.0.

The dispersion of inorganic fine particles on the surface of colored resin particles is made uniform enough by use of a mixing medium comprised of such substantially spherical particles.

The volume average particle size of a mixing medium particle is given by a mean of its minor axis and axis, and it is preferably 0.1 to 10 mm, especially 0.5 to 5 mm. Use of the mixing medium comprised of particles having such a size makes the mixed and dispersed state of colored resin particles and inorganic fine particles much more uniform.

The volume average particle size of mixing medium particles can be determined by steps of microphotographing these particles, measuring the axes and minor axes for 100 particles from the microphotograph, calculating the averages of axes and minor axes respectively, and then taking the arithmetic mean of the axis and minor axis.

The specific gravity of the mixing medium is preferably 1.0 to 8.0, especially 2.0 to 4.0. Use of a mixing medium having such a specific gravity allows the mixing medium to make a movement suitable for compressive action and shearing action caused by convection mixing as well as collisions of mixing medium particles among themselves.

The material of the mixing medium must be properly selected taking into consideration its gravity and contamination which may occur in the course of mixing colored resin particles with inorganic fine particles. Usually, it is selected from plastics, iron, glass and alumina.

In mixing, a vibration force generated, for example, by a rotary electric vibrator is applied to a mixing container in which colored resin particles, inorganic fine particles and a mixing medium are placed to perform a microscopically uniform mixing by means of convection mixing which utilizes the movement of the mixing medium, mixing which utilizes the compressive action and shearing action caused by collisions among mixing medium particles, and mixing which utilizes the frictional action caused by collisions of mixing medium particles with the container walls.

FIG. 1 illustrates an example of the manufacturing method of the invention in the order of process. 1 represents a premixer; 2, a quantity measuring feeder; 3, a vibration mill; and 4, a mixing medium.

In premixer 1, colored resin particles and inorganic fine particles are macroscopically mixed preliminarily.

The mixture is forwarded to quantity measuring feeder 2, from where a prescribed amount of the mixture is fed to vibration mill 3.

Vibration mill 3 is filled with mixing medium 4, and the colored resin particles and inorganic fine particles are mixed and dispersed by means of the mixing and stirring among the colored resin particles, inorganic fine particles and mixing medium caused by the vibration of vibration mill 3.

Figure 2:
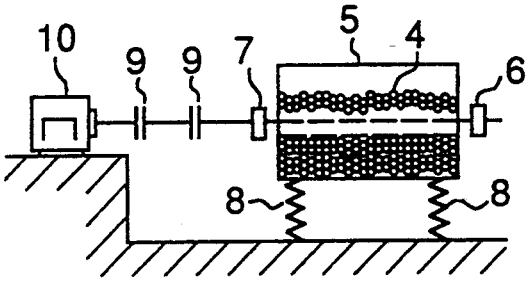
FIG. 2 is an explanation drawing to show details of a vibration mill usable in the manufacturing method of the invention.

FIG. 2 illustrates vibration mill 3 in detail, where 5 is the vibration mill machine body; 6 and 7 are eccentric vibration sources, respectively; 8 is a spring; 9, a flexible shaft coupling; and 10, a motor.

In vibration mill 3, the vibration produced by eccentric vibration sources 6 and 7 exerts a relatively small impact action on mixing medium particles 4, the colored resin particles and inorganic fine particles in vibration mill machine body 5 to perform the mixing. Mixing medium particles 4 repeat collisions while moving as a whole of vibration mill machine body 5, so that the colored resin particles and inorganic fine particles are dispersed with a microscopical uniformity.

Figure 3:
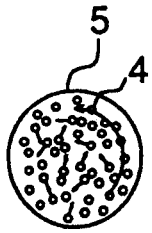
FIG. 3 illustrates the movement of the mixing medium in the vibration mill.

FIG. 3 is an explanation drawing which shows the movement of mixing medium particle 4 in vibration mill machine body viewed in the axial direction. By the action of vibration mill 3, mixing medium particles 4 moves rotatory in the vibrating mill 5 in the reverse direction to the rotating direction of motor 10 subjected to suppression, friction and shearing force.

Figures 4A, 4B, 4C:
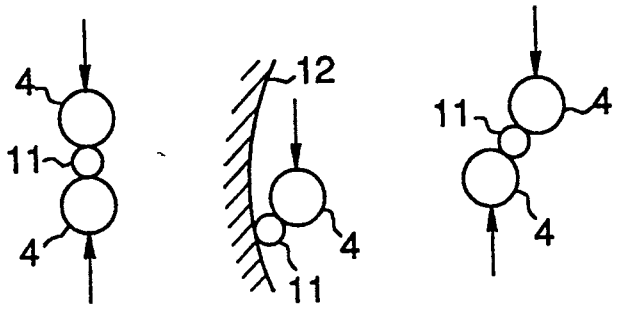
FIG. 4 is an explanation drawing to show the action of the mixing medium upon colored resin particle or inorganic fine particle in the vibration mill.

FIG. 4 is an explanation drawing which shows the action exerted by the mixing medium on the colored resin particles or inorganic fine particles in vibration mill machine body 5, where (a) is the compressive action; (b), the frictional action; and (c) , the shearing action. And 4 represents the mixing medium particles; 11, the colored resin particles or inorganic fine particles; 12, the inner walls of the vibration mill machine body; and the arrow indicates the direction in which the force is exerted.

While the colored resin particles and inorganic fine particles are subjected to the above compressive action, frictional action and shearing action in vibration mill machine body 5, the dispersion of the inorganic fine particles becomes uniform enough on the surface of the colored resin particles.

In the mixing by means of vibration mill 3, the size, specific gravity, material and filling rate of mixing medium particles 4; the amplitude and number of revolutions of the circular motion of vibration mill machine body 5; and the supply amounts of the colored resin particles and inorganic fine particles are properly set to obtain a desired mixed state.

The filling rate of the mixing medium, for example, is preferably 10 to 95%, especially 30 to 90% in apparent volume.

The amplitude of vibration mill machine body 5, or the diameter of a circular locus drawn by a specified point in the vibration of vibration mill machine body 5, is preferably ±0.2 to 50 mm, especially ±0.5 to 15 mm.

The number of revolutions of the eccentric motion by vibration mill machine body 5 is preferably 500 to 2000 rpm, especially 750 to 1250 rpm.

The diameter of vibration mill machine body is usually, 5 to 50 cm, preferably 10 to 30 cm.

As a vibration mill, the Vibromill made by Yasukawa Shoji Co. is commercially available. This apparatus is designed to mix colored resin particles and inorganic fine particles by allowing them to pass continuously through a container filled with a mixing medium, while adding a circular motion to the container. The mixing with this apparatus can be made more effective by adding a premixing process as shown in FIG. 1. In the premix process, colored resin particles and inorganic fine particles are premixed to a macroscopical dispersion before being mixed with the mixing medium.

As a commercially available product of such a premixer, the NX Mixer made by Hosokawa Micron Co., for example, is known.

In the continuous mixing process, it is preferable that the continuous supply amount of a mixture of the colored resin particles and inorganic fine particles be an amount at which the total volume of the colored resin particles, inorganic fine particles and mixing medium comes to 30 to 95%, especially 40 to 90%, of the capacity of the vibration mill.

The colored resin particles contain a binder resin, colorant and other additives and usually have an average particle size of 1 to 30 μn. The term "average particle size" used here means a volume average particle size determined by the electro-zone method on a Coulter counter Model TA-11 made by Coulter Co.

The binder for the colored resin particles is not particularly limited in type. But conventional toner resins, such as polyester resins, polystyrene resins, polyacrylic resins, styrene-acrylic copolymer resins and epoxy resins, are usually employed.

As the colorant contained in the colored resin particles, there can be used, for example, carbon black, Nigrosines, aniline blue, Calco oil blue, chrome yellow, ultramarine blue, DuPont Oil Red, quinoline yellow, methylene blue chloride, phthalocyanine blue, malachite green oxalate, lamp black and Rose Bengal.

The other additives include, for example, fixing improvers such as waxes. Further, magnetic particles are added in colored resin particles in making a magnetic toner. As such magnetic particles, ferrite or magnetite particles having an average particle size of 0.1 to 2 μm are usually employed in amount of 20 to 70 wt % of colored resin particles.

The size of the inorganic fine particles to be mixed with the colored resin particles is preferably 5 to 500 nm, especially 10 to 100 nm, in primary average particle size. The primary average particle size of the inorganic fine particles is that which is determined by photomicrography, which comprises the steps of photographing these particles with an electron microscopy, measuring the diameters of 3000 to 5000 particles from the photograph, and determining an arithmetic mean of the measured values to obtain a primary average particle size.

Materials usable as the inorganic fine particles include, for example, oxides such as silica, alumina, titania, zinc oxide, zirconium oxide, chromium oxide, cerium oxide, tungsten oxide, antimony oxide, copper oxide, tin oxide, tellurium oxide, manganese oxide, boron oxide, barium titanate, aluminum titanate, magnesium titanate, calcium titanate, strontium titanate; carbides such as silicon carbide, tungsten carbide, boron carbide, titanium carbide; and nitrides such as silicon nitride, titanium nitride, boron nitride. Of them, particularly preferable one is silica fine particles subjected to a hydrophobic treatment, in view of flowability and electrification stability of a toner. As a hydrophobic treatment agent, a silane coupling agent or titanium coupling agent can be used.

The addition ratio of the inorganic fine particles is preferably 0.1 to 5.0 wt %, especially 0.1 to 2.0 wt % of the colored resin particles.. At such an addition ratio, the effect of the addition can be satisfactorily brought out, and the problems resulting from the dissociation of inorganic fine particles are prevented.

In one preferable embodiment of the method for manufacturing the colored resin particles, a binder resin, colorant, and other additives if necessary, are mixed, melted and kneaded, and then cooled, pulverized and classified to prepare colored resin particles having a desired average particle size.

The toner of the invention may be used as a two-component developer in combination with a carrier, or as a one-component developer comprised of a magnetic toner alone.

EXAMPLES

In the following examples, "part (s)" means "part (s) by weight".

EXAMPLE 1

| | |
|---|---|
| Styrene-acrylic copolymer resin | 100 parts |
| Carbon black (Mogal L made by Cabot Corp.) | 10 parts |
| Polypropylene wax (Viscol 660P made by Sanyo Chemical Ind.) | 5 parts |

The above materials were kneaded with heating, and then cooled, pulverized and classified, so that colored resin particle 1 having a volume average particle size of 8 μm was obtained.

To this colored resin particle 1 was added a positively electrified hydrophobic colloidal silica so as to make an addition ratio of 1.04 wt %. These were premixed in the premixer shown in FIG. 1 and then temporarily stocked in the quantity measuring feeder shown in FIG. 1.

Subsequently, the premixture was continuously fed from the quantity measuring feeder to the vibration mill shown in FIG. 1, which was filled with a mixing medium comprised of substantially spherical particles. Mixing was performed by driving the vibration mill in the presence of this mixing medium. Then, the mixture was collected as toner 1.

The mixing medium used in the vibration mill was comprised of spherical glass particles having an average minor axis a of 2 mm, average axis b of 2 mm, ratio a/b of 1 and specific gravity of 2.5. The filling rate of the mixing medium in the container was set at 80% in apparent volume. With the vibration mill, the amplitude was set at ±8 mm; the number of revolutions, at 1000 rpm; and the supply amount of the premixture, at 200 kg/hr.

Toner 1 collected as the above was passed through a 200-mesh sieve. At that time, the amount of the colloidal silica contained in toner 1 was measured before and after the passage through the sieve by use of a Fluorescent X-ray Analyzer System 3070 made by Rigaku Denki Co. The results showed that when the content of the colloidal silica before the passage was denoted by A% and that after the passage was denoted by B%, the ratio B/A was 0.98. This value was higher than the values obtained with comparative toners 1 and 2 prepared by conventional methods as described later in Comparative Examples 1 and 2. This indicates that the amount of dissociated colloidal silica was smaller in toner 1.

In an electron microscopic observation of the toner 1 surface, no local embedment of the colloidal silica was found, and it was confirmed that the colloidal silica was softly and uniformly dispersed on the surface of the colored resin particles.

Figure 5:
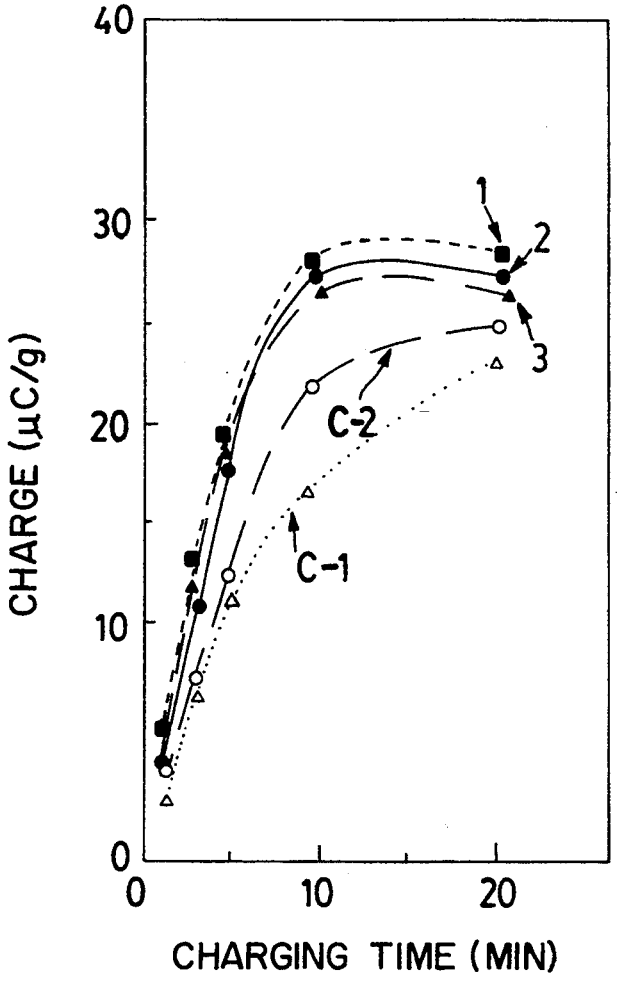
FIG. 5 is a graph showing electrification speeds of toners obtained in Example 1 and Comparative Examples 1 and 2, respectively.

Further, measurement of the electrification speed of toner 1 by the blow-off method gave the results shown in FIG. 5. These results prove that toner 1 prepared in Example 1 has an electrification speed higher than those of comparative toners 1 and 2 prepared in Comparative Examples 1 and 2.

EXAMPLE 2

The same procedure as in Example 1 was repeated, except that the mixing medium used was comprised of spherical glass particles having an average minor axis a of 2.8 mm, average axis b of 3 mm, ratio a/b of 0.93 and specific gravity of 2.5. The results obtained were much the same as those in Example 1. At that time, the apparent volume was 40%, and the ratio B/A was 0.96.

EXAMPLE 3

The same procedure as in Example 1 was repeated, except that the mixing medium used was comprised of spherical alumina particles having an average minor axis a of 1 mm, average axis b of 1 mm, ratio a/b of 1 and specific gravity of 3.6. The results obtained were much the same as those in Example 1. At that time, the apparent volume was 40%, and the ratio B/A was 0.98.

COMPARATIVE EXAMPLE 1

Ten grams of colored resin particles prepared in the same manner as in Example 1 was placed in a non-vibrating fixed container type mixer, Henschel Mixer Model FM-75J made by Mitsui Miike Kako Co. After adding thereto the same additives as in Example 1, mixing was performed to obtain comparative toner 1.

In this mixer, the peripheral speed of the stirring blades was set at 40 m/s; the mixing time, to 20 min; the mixing temperature, at 20° to 30° C.; and the mixing quantity, at 30 kg/hr.

Comparative toner 1 obtained as the above was passed through a 200-mesh sieve to determine the ratio B/A as in Example 1. The ratio obtained was 0.91 and inferior to that of the toner in Example 1.

When the surface condition of comparative toner 1 was observed on an electron microscopy, local embedments of the colloidal silica were found, and the dispersion of the colloidal silica on the surface of colored resin particles was ununiform.

Measurement of the electrification speed of comparative toner 1 in the same manner as in Example 1 gave a value lower than that of toner 1, as is shown in FIG. 5.

In addition, the mixing amount was 30 kg/hr at that time, and a much longer time was needed to mix a unit weight of the materials.

COMPARATIVE EXAMPLE 2

The same colloidal silica as in Example 1 was added to colored resin particles prepared in the same manner as in Example 1, and these were stocked in the quantity measuring feeder. Then, these colored resin particles and colloidal silica were continuously fed from the quantity measuring feeder to a LIMMAC electromagnetic mixer made by Fuji Electric Co. at a feed speed of 50 kg/hr and then mixed, comparative toner 2 was thus obtained.

In the mixing zone of the LIMMAC electromagnetic mixer, 200 g of a mixing medium comprised of magnetic rods having a diameter of 0.5 mm and axis of 4 mm was placed prior to the mixing. The filling rate was 5% in apparent volume.

Comparative toner 2 prepared as the above was passed through a 200-mesh sieve to determine the ratio B/A, the ratio obtained was 0.85 and inferior to the value obtained in Example 1.

By means of an electron microscopic observation, local embed/Rents of the colloidal silica were found, it was also found that the dispersion of the colloidal silica on the colored resin particle surface was not uniform.

When the electrification speed of comparative toner was measured in the same procedure as in Example 1, it was inferior to that of toner 1 in Example 1 as shown in FIG. 5. Further, it took a longer time than toner 1 to mix the same weight of the materials.

The invention comprises use of a mixing medium comprised of substantially spherical particles, and thereby it can provide an electrostatic image developing toner in which inorganic fine particles are dispersed uniformly, without dissociation, on the surface of colored resin particles.

What is claimed is:

1. A process for producing a toner comprising;

mixing colored resin particles having an average particle size of 1 to 30 μm and inorganic fine particles having a primary particle size of 5 to 500 nm to form a premix, supplying said premix to a vibrating mill, and stirring said premix in the presence of a mixing medium in said mill to form toner particles comprising said colored resin particles and said inorganic fine particles on a surface of said colored resin particles, wherein said medium is selected from the group consisting of plastics, iron, glass, and aluminum, said medium having a substantially spherical shape in the container, said medium having a ratio of minor axis to major axis of 0.8 to 1.0.

2. The process of claim 1 wherein a specific gravity of said medium is 2.0 to 4.0, said process further comprising moving said mill eccentrically while said mill is vibrating.

3. A process of claim 1 wherein a volume average particle diameter of the mixing medium is 0.1 to 10 mm.

4. A process of claim 1 wherein a specific gravity of the mixing medium is 2.0 to 4.0.

5. A process of claim 1 wherein filling rate of the mixing medium to the volume of the container is 10 to 95%.

6. A process of claim 1 wherein the vibration mill vibrates at a time of stirring.

7. A process of claim 6 wherein an amplitude of vibration mill is ±0.2 to 50 mm.

8. A process of claim 1 wherein the vibration mill moves eccentrically at the stirring.

9. A process of claim 8 wherein revolutions of the eccentric motion by the vibration mill is preferably 500 to 2000 rpm.

10. A process of claim 1 wherein ratio of the inorganic fine particles to the colored resin particles is preferably 0.1 t 5.0 wt %.

11. The process of claim 1 wherein said colored resin particles are produced by mixing a binder resin and a colorant to form a mixture, melting, kneading, and cooling said mixture to form a cooled mixture, and pulverizing and classifying said cooled mixture to form said colored resin particles having said average particle size.

12. The process of claim 1 wherein said fine particles comprise silica.

13. The process of claim 12 wherein said silica is subjected to hydrophobic treatment.

* * * * *